United States Patent [19]

Kalleberg

[11] 4,290,832

[45] Sep. 22, 1981

[54] METHOD FOR MAKING FASTENERS

[75] Inventor: Melvin O. Kalleberg, Minneapolis, Minn.

[73] Assignee: Minnesota Mining and Manufacturing Company, St. Paul, Minn.

[21] Appl. No.: 830,174

[22] Filed: Sep. 2, 1977

Related U.S. Application Data

[62] Division of Ser. No. 714,132, Aug. 13, 1976, abandoned.

[51] Int. Cl.[2] ..... B32B 31/00

[52] U.S. Cl. ..... 156/72; 24/204; 28/161; 156/178; 156/435; 428/99

[58] Field of Search ..... 156/72, 435, 254, 176, 156/177, 178, 179; 24/204; 28/161; 428/85, 92, 93, 94, 99, 100, 399

[56] References Cited

U.S. PATENT DOCUMENTS

| | | | |
|---|---|---|---|
| Re. 26,629 | 7/1969 | Nealis | 24/205.12 |
| 3,010,508 | 11/1961 | Wilson | 156/459 |
| 3,136,026 | 6/1964 | De Mestral | 28/161 |
| 3,138,841 | 6/1964 | Naimer | 24/204 |
| 3,192,589 | 7/1965 | Pearson | 24/204 |
| 3,266,113 | 8/1966 | Flanagan, Jr. | 24/204 |
| 3,363,038 | 1/1968 | Billarant | 24/204 |
| 3,365,757 | 1/1968 | Billarant | 24/204 |
| 3,408,705 | 11/1968 | Kayser et al. | 24/204 |
| 3,475,264 | 10/1969 | Donaldson | 156/179 |
| 3,527,001 | 9/1970 | Kleemeier et al. | 51/358 |
| 3,577,607 | 5/1971 | Ikoma | 24/204 |
| 3,629,032 | 12/1971 | Erb | 156/435 |
| 3,676,239 | 7/1972 | Soehngen | 156/306 |
| 3,790,426 | 2/1974 | Bylund | 156/435 |
| 3,816,204 | 6/1974 | Nagayoshi et al. | 156/72 |
| 3,847,691 | 11/1974 | Currell | 156/72 |
| 3,879,835 | 4/1975 | Brumlik | 24/204 |
| 3,961,398 | 6/1976 | Herterich et al. | 24/204 |
| 4,024,003 | 5/1977 | Buhler | 28/161 |

FOREIGN PATENT DOCUMENTS

| | | | |
|---|---|---|---|
| 959247 | 12/1974 | Canada | 24/204 |
| 2047243 | 3/1971 | France . | |
| 589380 | 3/1959 | Italy . | |

OTHER PUBLICATIONS

Carpets, George Robinson, Textile Book Service 1972, Great Britain, pp. 216–219.

*Primary Examiner*—Michael W. Ball
*Attorney, Agent, or Firm*—Cruzan Alexander; Donald M. Sell; William L. Huebsch

[57] ABSTRACT

A method for forming a strip material useful as part of a fastener. The method steps comprise moving two backing layers from opposite directions around guides and away from the guides in parallel paths, feeding monofilaments between the guides, pressing the monofilaments first into engagement with one and then the other of the backing layers on the guides so that lengths of the filaments extend normally between the backing layers along the parallel paths, severing those normally extending monofilaments halfway between the backing layers, and heating the newly severed terminal ends of the monofilaments to form heads.

5 Claims, 11 Drawing Figures

METHOD FOR MAKING FASTENERS

This is a division of application Ser. No. 714,132 filed Aug. 13, 1976 now abandoned.

BACKGROUND OF THE INVENTION

This invention relates to methods for making fasteners of the type including two articles, at least one of which includes a field of headed projections adapted to releasably interengage with the other article, and in one aspect to methods for making such fasteners in which both articles include an array of headed projections which can be simultaneously engaged without regard to the relative angular relationship of the arrays.

The art is replete with descriptions of fasteners including two articles, at least one of which includes a field of headed projections. U.S. Pat. No. 3,138,841 describes such a fastener in which one article comprises a woven fabric backing from which extend a plurality of headed projections adapted to mate with loops of fiber projecting from another article. The projections on this article are provided by a plurality of flexible resilient monofilaments of longitudinally oriented polymeric material each including a central portion woven into the backing and end portions that form the projections. Such articles are produced by weaving two backing layers in parallel closely spaced relationship with the monofilaments being woven therebetween. The monofilaments are then severed midway between the backing layers to form two brush-like halves, and the newly severed projecting filaments are heated to form heads on their terminal ends. These articles, however, are expensive to make because of the weaving required, and the woven backing does not hold the monofilaments as tightly as may be desired. While the weaving process used precisely places the projections, it does not allow as much versatility as may be desired with regard to alternate positions for the projections of the backing, and thus would not allow them to be positioned in a pattern in which the projections on two such woven articles could most effectively interengage.

U.S. Pat. No. 3,527,001 teaches embedding projections of a longitudinally oriented polymeric material in a resinuous polymeric bonding layer and heading the projections so that they will releasably engage a low density fibrous cleaning disk. While fasteners including one article made by the flocking procedure taught in U.S. Pat. No. 3,527,001 might suitably engage another article of an open fibrous material, the flocking procedure taught is more time consuming and expensive than is desired for a low cost fastener article, and the positioning of projections on the headed article provided is too unpredictable to reliably produce two articles having headed projections that will effectively interengage.

The art also describes fasteners in which each of two articles do have a field of headed projections adapted to reliably and effectively interengage similar projections on the other article to releasably close the fastener. U.S. Pat. Nos. Re. 26,629; 3,266,113; 3,408,705; and 3,192,589 are illustrative. The articles described in these patents, however, also have certain disadvantages.

The heads of such articles must have clearance for movement past each other during engagement. The projections of some articles must be progressively engaged in the manner of engagement of the teeth of a zipper so that this clearance is provided on one side of the row of projections moving into engagement (see U.S. Pat. Nos. Re. 26,629 and 3,192,589). These articles require bending of their backings to allow their projections to sequentially engage or disengage which is normally not possible when the fasteners are used to attach two rigid members.

Other prior art articles have been specifically designed so that all of the headed projections on both articles can reliably be simultaneously moved past each other. This allows the articles to have a rigid backing or be fixed on a rigid surface, which is desirable for many applications. For such articles, however, clearance space must be provided within the pattern of projections. Two methods of providing such clearance space have been taught. U.S. Pat. No. 3,266,113 teaches deleting certain projections from an otherwise ordered array of projections to provide the clearance space needed for simultaneous movement of the heads past each other. Before the projections of this fastener will engage, however, the arrays in which they are disposed must be oriented in one of a limited number of predetermined angular relationships relative to each other. Such orientation of the arrays is inconvenient for many uses. U.S. Pat. No. 3,408,705 teaches providing the clearance space within an unordered array of projections which have minimum spacings from each other to allow engagement of the projections when the arrays in which they are disposed are oriented in any angular relationship relative to each other. While this fastener is more versatile, it like the articles of U.S. Pat. No. 3,266,113 is of a molded construction. Molding such articles is relatively expensive and produces projections which have less strength for a given diameter than do projections formed of the same material which is longitudinally oriented.

SUMMARY OF THE INVENTION

The present invention provides a fastener of the aforementioned type comprising at least one article including a backing supporting a multiplicity of headed projections adapted to releasably engage a second article. The headed projections are of longitudinally oriented polymeric material which is securely bonded to the backing. The fastener can include one such article for engagement with a conventional fibrous article, or can include two of such articles each with its projections disposed in an array which affords reliable simultaneous engagement of the projections in any angular orientation of the arrays while providing a high holding force for the fastener in any such orientation.

The present invention also includes a method for rapidly producing the article with its headed projections at substantially less cost than the cost to cast a similarly shaped article. Also the method provides great versatility in the length and head size of the projections and the arrays in which they are disposed as may be desired for specific applications of the articles.

The articles according to the present invention includes a backing comprising a non-fibrous non-oriented polymeric surface bonding layer with an exposed major surface, and a plurality of elongate flexible resilient generally U-shaped monofilaments of longitudinally oriented polymeric material each having a central bight portion firmly bonded in the surface layer (i.e. by being embedded in and adhered or fused to the surface layer) so that stem portions at the ends of the central portion project generally at right angles to the backing. Each stem portion has an enlarged head at its terminal end adapted to engage the other article of the fastener.

When the fastener consists of two such articles each head has a cam surface opposite the backing from which it is supported adapted for engagement with the cam surface on the head of one of the monofilaments of the other article to produce side deflection of at least one of the engaging heads upon movement of the heads toward each other. The U-shaped monofilaments are bonded to the backing with their central bight portions generally parallel and disposed in a series of generally parallel rows with the U-shaped elements along and between the rows spaced to position their stem portions in arrays which afford movement of the heads of the other article therebetween, but only upon resilient displacement of most of the heads.

The method according to the present invention for forming articles comprises the steps of moving two backing strips or layers (which strips are incorporated in the backings for the articles produced) from generally opposite directions around parallel spaced arcuate guides at a bonding station and away from the guides in the same direction along parallel paths. Spaced parallel lengths of the polymeric monofilaments are fed between the spaced guides from their sides opposite the parallel paths and in a direction generally parallel to the parallel paths. Longitudinal striking bars disposed generally transverse of the paths alternately press the monofilaments first into engagement with one and then the other of the backing strips as the backing strips are moved around the arcuate guides. The striking bars thus press generally U-shaped lengths or segments of each filament against the strips where the U-shaped lengths are bonded (by means described in the next paragraph) in positions spaced longitudinally along the moving strips with the lengths of the monofilaments between the U-shaped segments extending generally normally between the strips. The monofilaments are then severed midway between the strips to form two brush-like halves. The newly severed terminal ends of the monofilaments projecting from the strips are then heated to form heads having arcuate cam surfaces opposite the strips, and the strips are severed into short lengths to form a plurality of the articles according to the present invention.

Where a surface layer of the strip is of a heat softenable material, the monofilaments may be bonded to the strip be heating the strip on the guides until the surface layer is sufficiently soft that the U-shaped lengths of the monofilaments will be embedded in the surface layer by the striking bars. Alternatively the monofilaments may be bonded by coating the strip with a surface layer of adhesive into which the U-shaped segments are pressed.

When the polymeric material of the monofilaments is the same as the material of the heat softened surface layer into which the monofilaments are pressed the monofilaments can be caused to fuse in the surface layer so completely that in some cases portions of the monofilaments are hard to separately identify from the material of the surface layer.

With this method of production the spacing between the stems transverse of the strip can be controlled by the spacing between the monofilaments being fed between the arcuate guides. The spacing between the stem portions of the U-shaped lengths of monofilament are controlled by the thickness of the blade which presses the filament into the strip. The spacing between pairs of rows of the stems longitudinally of the strip is controlled by the timing relative to the speed of the strip at which the blade presses the monofilaments into engagement therewith. Also the lengths of the stems are controlled by the spacing between the strips along their parallel paths and the diameters of the heads formed on the stem portions are controlled by the amount of heat applied to the stems.

By this production method the rows of stems can be disposed in a rectangular array with the cross rows and longitudinal rows respectively normal and parallel to the edges of the strip, and with all of the stems equally spaced along each row. With such an even rectangular array, however, it has been found that the heads of the articles engage most securely when the rows of stems of the two articles are disposed at some angle to each other as opposed to being parallel, this being particularly true with respect to shearing of the articles in directions parallel to their backings and to the rows. Thus it may be desirable to do one or more of the following: (1) vary the spacings of the stems along the rows extending longitudinally of the strip by use of the techniques described above so that at least when the rows of two articles with such varied spacing are engaged at right angles to each other a greater separating and shear strengths will be developed, (2) dispose the rows of U-shaped filaments so that their stems are not aligned normal to or parallel with the edges of the strip so that when a user engages two articles made from the strip with their edges aligned (as he would normally be expected to do) the rows on the articles will cross each other to develop the maximum strength in the fastener both in tension and shear (this can be done by orienting all or portions of the striking bars at an acute angle with respect to the edge of the strip moving through the tacking station), or (3) shift successive rows of U-shaped filaments slightly in a direction transverse of the strip so that the stems of successive rows will not be aligned and thus will not permit shearing longitudinally of the strip (this can be done by varying the position of the spaced filaments fed to the tacking station transversely of the strip).

The stem portions in the U-shaped monofilaments must be sufficiently long and flexible so that upon engagement of the articles the heads on each article can move to find spaces between the heads on the other article and permit simultaneous movement of the heads past each other in any orientation of the rows of stems of the articles relative to each other. To permit such movement the stems should have a length which is at least equal to the maximum diameter of the head, and preferably in the range of about $2\frac{1}{4}$ to 3 times the maximum diameter of the head.

BRIEF DESCRIPTION OF THE DRAWING

The invention will be further described with reference to the accompanying drawing wherein like numbers refer to like parts in the several views, and wherein.

DESCRIPTION OF THE PREFERRED EMBODIMENTS

Figure 1:
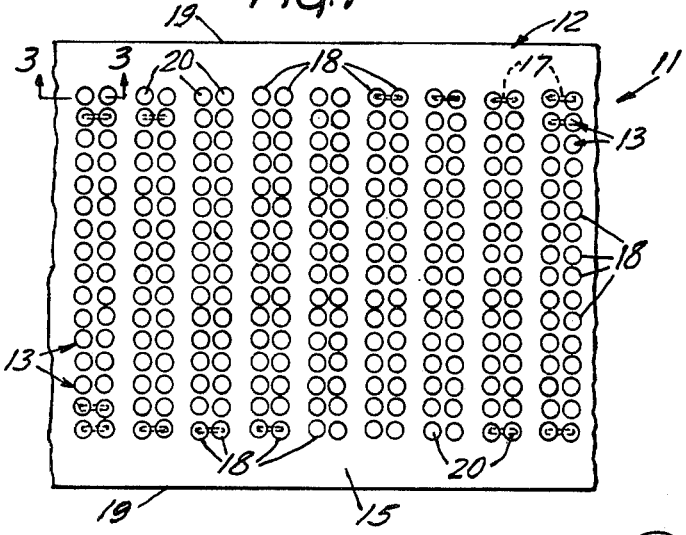
FIG. 1 is a plan view of one of the articles of a fastener according to the present invention.
Figure 3:
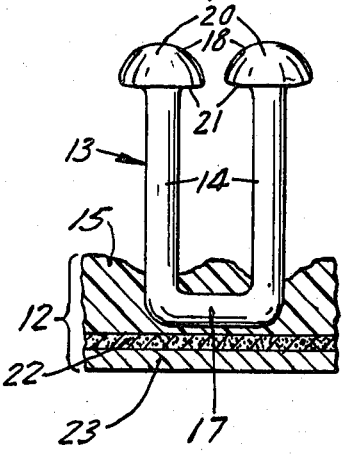
FIG. 3 is an enlarged section taken approximately along line 3—3 of FIG. 1.
Figure 2:
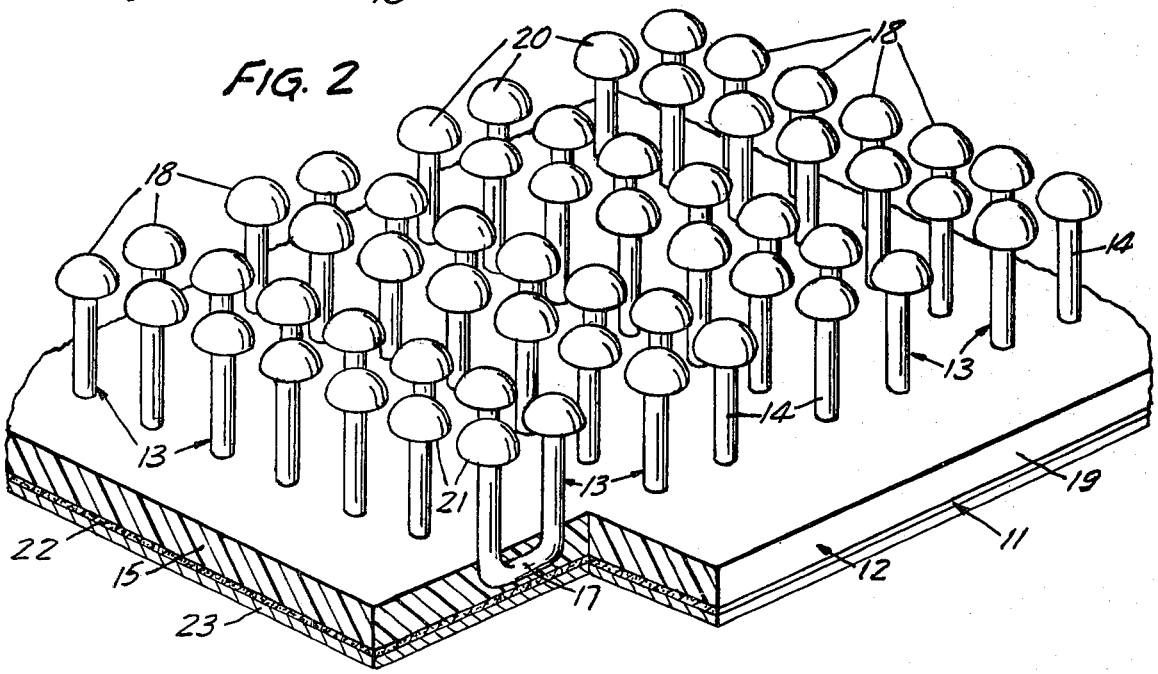
FIG. 2 is an enlarged fragmentary view in perspective of the article of FIG. 1.
Figure 4:
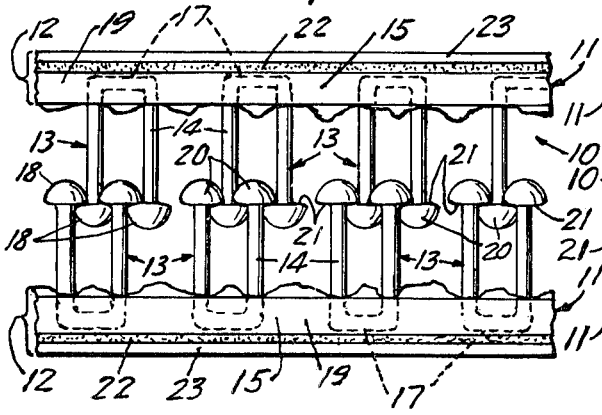
FIGS. 4 and 5 are both side views showing the fastener according to the present invention with its articles engaged which illustrate two different orientations of the rows of projections during engagement.
Figure 5:
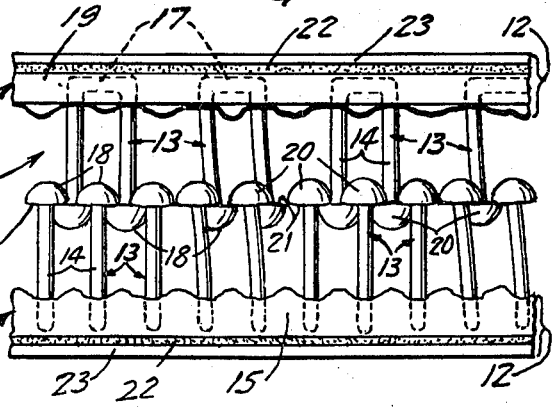

Referring now to FIGS. 4 and 5 of the drawing, there is illustrated a fastener according to the present invention, generally designated by the numeral 10 which comprises two identical articles 11, one of which is illustrated in FIGS. 1, 2 and 3.

Each article 11 includes a backing 12 comprising a non-fibrous non-oriented polymeric surface bonding layer 15 in which is bonded a plurality of flexible resilient generally U-shaped monofilaments 13 (FIGS. 2 and 3) of longitudinally oriented polymeric material. Each monofilament 13 comprises two stem portions or stems 14 projecting at generally a right angle from a major surface of the surface layer 15 and extending from the ends of a bight portion 17 of the monofilament 13. As can be seen in FIGS. 2, 3 and 4, the bight portions 17 in each article 11 lie generally parallel to and are embedded in the material of its surface layer 15. A generally hemispherical head 18 is the free end of each stem 14. The heads 18 have arcuate generally semispherical cam surfaces 20 opposite the backing 12 adapted for engagement with the cam surfaces 20 on the heads 18 of the other article 11 to produce the necessary side deflection of the stems 14 upon movement of the heads 18 toward each other with the backings 12 generally parallel so that the heads 18 may simultaneously pass to engage the articles 11 in the manners illustrated in FIGS. 4 or 5. Also the heads 18 each have a generally planar latching surface 21 extending radially outwardly of the stem 14 and adapted to engage the latching surface 21 on one of the heads 18 of the other article 11 to retain the engaged heads 18 in engagement until a predetermined force is applied to separate the articles 11. Since engagement of the latching surfaces 21 do not produce as much camming action as engagement of the cam surfaces 20, the configuration of the heads 18 desirably requires a force to engage the articles 11 which is not much larger than the force required to separate them.

The monofilaments 13 are bonded to the backing with their bight portions 17 parallel to each other and to parallel edges 19 of the backing 12. The bight portions 17 of groups of the monofilaments 13 are disposed side by side to form a series of generally parallel rows, with each row of monofilaments 13 providing two corresponding rows of aligned stem portions 14 and heads 18 which are disposed generally normal to the edges 19.

The stem portions 14 on each U-shaped monofilament 13 and the adjacent stem portions 14 along the rows (i.e. in a direction normal to the length of the bight portions 17 and to the edges 19) are spaced apart so that the head 18 of another monofilament 13 may be positioned therebetween without substantially spreading the stems 14. The heads 18 on these stems 14, however, are spaced apart a distance less than their own diameter so that a head 18 on a mating article 11 may only move therebetween upon separation of the heads 18 by resilient deflection of the stems 14.

The heads 18 of adjacent rows of the U-shaped monofilaments 13 are spaced apart a distance somewhat greater than the distance between the heads 18 of each U-shaped monofilament or the distance between adjacent heads 18 along each row to provide the aforementioned advantage with respect to the shear strength of the fastener. This larger spacing is experimentally determined so that it is sufficient to afford movement of the heads 18 on each of the articles 11 simultaneously past each other with the backings 12 of the articles 11 maintained parallel to each other and with the rows of U-shaped monofilaments 13 in any relative angular orientation. This spacing, however, is generally no greater than that required for such engagement so as to provide the maximum disengagement force for the articles 11.

In addition to the surface layer 15, the backing 12 as illustrated includes a layer of pressure sensitive adhesive 22 on the surface of the layer 15 opposite the U-shaped monofilaments 13, and a removable release liner 23 over the layer of adhesive 22. The layer of adhesive 22 affords firm adhesion of the articles 11 to rigid surfaces to be releasably joined thereby.

Figure 6:
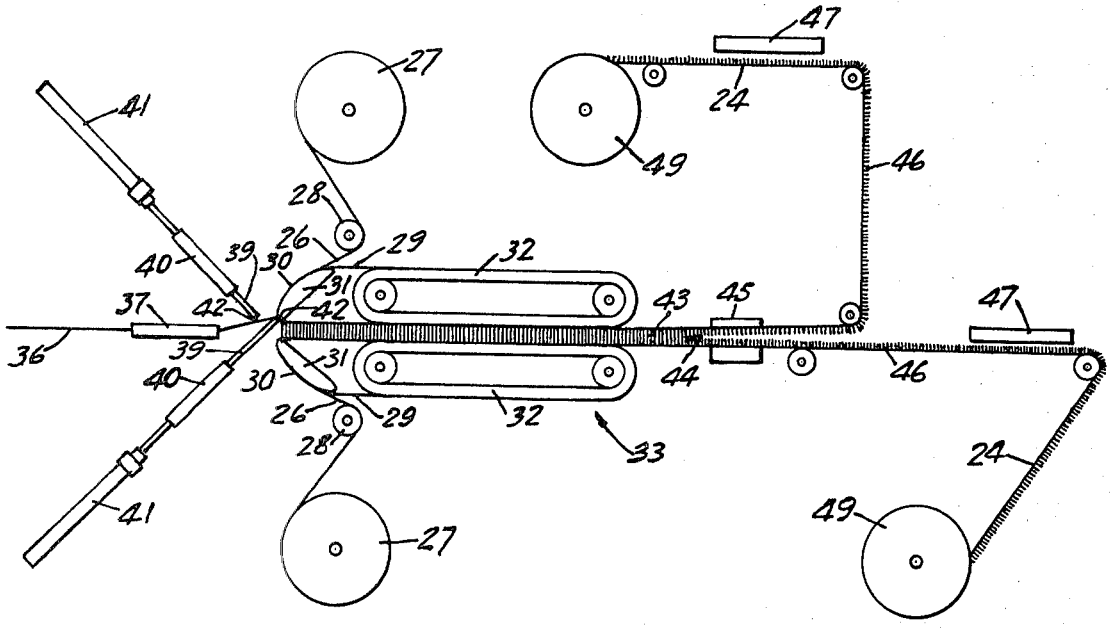
FIG. 6 is a schematic view illustrating a method according to the present invention for making the article of FIG. 1.

FIG. 6 schematically illustrates a method according to the present invention for continuous forming of an elongate structure 24 from which may be cut desired lengths to provide the articles 11. Two backing strips or layers 26 of heat softenable polymeric material to be incorporated in the backing extend from generally opposite directions from supply rolls 27, each extending from the supply roll 27 around a guide roller 28 mounted via a friction clutch to provide a desired tension in the strip 26. From the guide roller 28, each strip 26 passes onto an endless support belt 29 (such as of aluminum) extending around the arcuate surface 30 of a platen 31 heated to a temperature adapted to soften the polymeric strip 26 and between one cushion belt 32 of a commercial extrusion take-off device 33 (e.g. a Model No. 3-650-vt as manufactured by Teledyne Farris Eng. Co. Palisades Park, N.J.). The portions of the support belts 29 passing around the adjacent ends of the heated platens 31 provide arcuate spaced parallel support surfaces around which the strips 26 are moved onto parallel paths between portions of the support belts 29 passing between the cushion belts 32 of the take-off device 33.

A plurality of flexible resilient monofilaments 36 are guided between the adjacent ends of the platens 31 by a guide 37 comprising a plurality of small parallel side by side evenly spaced tubes through each of which one of the monofilaments 36 is positioned. A pair of longitudinal striking bars 39 are mounted on opposite sides of the path for the monofilaments with each one being mounted for reciprocal motion in a guide 40 by activation of a driving means such as an air cylinder 41 between a retracted position (shown for the upper striker bar 39) spaced from the monofilaments 36, and a pressing position (shown for the lower striker bar 39) at which an end surface 42 on the striker bar 39 presses the monofilaments 36 into the softened strip material 26 on the support belt 29 along the curved surface of the heated platen 31. The end surfaces 42 of the striker bars 39 are convex to match the adjacent contour of the platen 31, have a width sufficient to contact all of the monofilaments 36 guided between the platens 31, and have thicknesses adapted to form U-shaped lengths of the monofilaments 36 having base segments of a predetermined width when they press the monofilaments 36 into the strips 26 so that the base segments are embedded in and bonded to the strips 26.

The striker bars 39 are controlled to alternately strike the platen 31 so that the monofilaments 36 will be bonded first to one and then to the other of the strips 26 with the lengths of monofilament 36 therebetween extending generally normal to their opposing surfaces to form a laminated structure 43. The operational frequency of the striker bars 39 and/or the speed of the take-off device 33 are regulated to provide a desired spacing between the U-shaped lengths of monofilaments bonded to the strips 26. After the laminated structure 43 has passed through the take-off device 33 so that the polymeric strips 26 have again solidified, the laminated structure 43 engages a sharp transversely positioned blade 44 which is parallel to and midway between the opposing surfaces of the strips 26 in the structure 43. The blade 44 is reciprocated, as by a saber saw drive mechanism 45, to cut the laminated structure 43 into two brush-like halves 46, each of which halves 46 comprises one of the strips 26 and multiplicity of generally U-shaped lengths of the monofilaments 36 having projecting end portions. Each half 46 is then guided along a separate path past a heated platen 47 which heats the air at the ends of the projecting end portions of the monofilaments 36 to cause those ends to soften and form into generally hemispherically shaped heads. From the platens 47 the headed elongate structures 24 are guided to devices which wind them on reels 49 ready to be cut to length for use as articles 11 for a fastener 10.

As will be understood, many modifications may be made in the method illustrated in FIG. 6 without departing from the spirit of the present invention. For example, the strips 26 of polymeric material may be formed by extruder heads positioned adjacent the arcuate guides 31. The monofilaments may be adhered in surface layers deposited on the strips 26 by adhesive applying devices between the roller and guides 31, and the guides need not be heated unless heat is required to cure the adhesive. Also the knife 44 may be replaced with a hot wire for providing the cutting step, which hot wire may provide at least a portion of the heat required for heading.

FIGS. 7, 8, 9 and 10 illustrate alternate embodiments of an article according to the present invention in which parts similar to parts in the article 11 are similarly numbered except for the respective addition of one of the suffixes "a", "b", "c" or "d".

Figure 7:
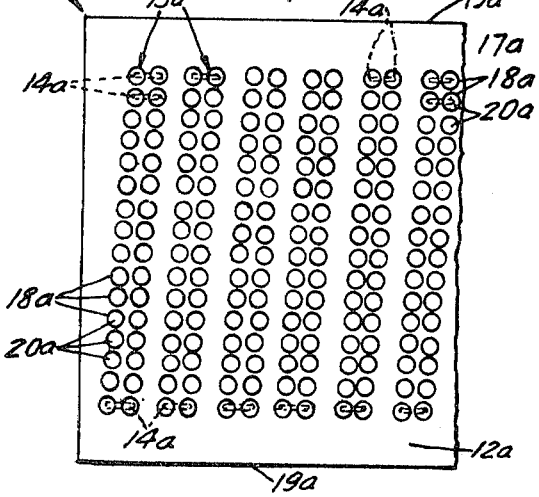
FIGS. 7, 8, 9, and 10 illustrate alternate embodiments of the articles in a fastener according to the present invention.

The article 50 illustrated in FIG. 7 can be made according to the method illustrated in FIG. 6 after a modification to the striker bars 39 which press the monofilaments 36 against the strips 26 so that the end surfaces 42 of the striking bars are set at an acute angle with the edges of the path for the strips 26. Like the article 10, the article 50 comprises an elongate backing 12*a* having parallel edges 19*a*. In the backing 12*a* are bonded a multiplicity of flexible resilient generally U-shaped monofilaments 13*a* of longitudinally oriented polymeric material. Each monofilament 13*a* includes a central bight portion 17*a*, and two projecting stem portions 14*a* each terminating in a head 18*a* defining an outer cam surface 20*a*. Also like the article 11, the bight portions 17*a* of the U-shaped monofilament 13*a* are disposed generally parallel to each other and to the edges 19*a*, and a plurality of groups of the bight portions 17*a* are disposed generally side by side to form a plurality of generally parallel straight rows of monofilaments 13*a* and heads 18*a*. In the article 50 of FIG. 7, however, the rows of monofilaments 13*a* are disposed at an acute angle with the parallel edges 19*a* of the article 50 which angle corresponds to the angle at which the striker bars 39 are set.

Figure 8:
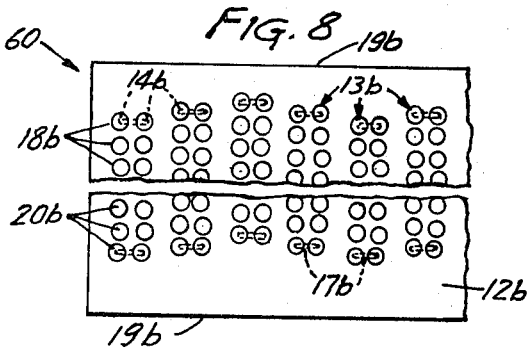
Figure 9:
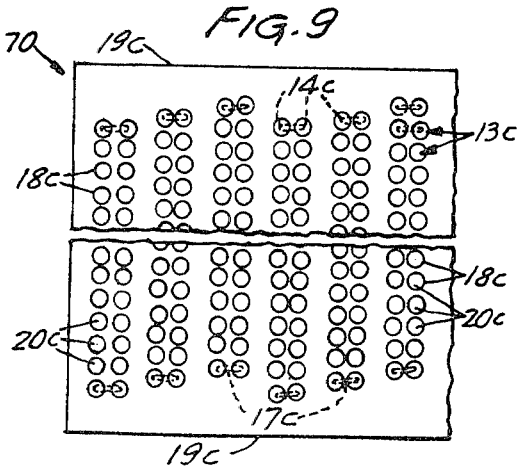
Figure 10:
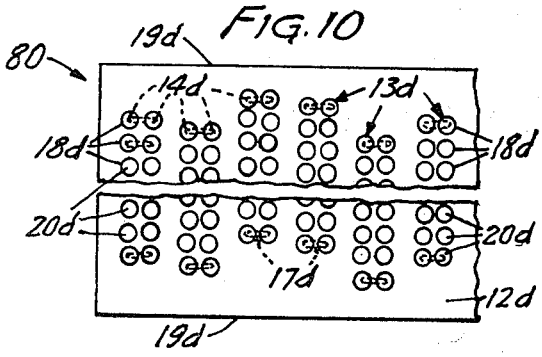

FIGS. 8, 9 and 10 illustrate second, third and fourth alternate embodiments for articles 60, 70, and 80 according to the present invention which can also be made by the method illustrated in FIG. 6 with the addition of one method step. The added method step is that of varying the position of the guide 37 transversely of the path for the strip 26. Such variation can for example be done by cam arrangements in a sinusoidal pattern to produce articles with heads disposed in rows arranged as illustrated in FIG. 8, or in a saw tooth pattern to produce heads disposed in rows as illustrated in FIG. 9. Alternatively, as illustrated in FIG. 10, such variation can be in a random pattern. In any event it is desirable that the variation shift the stems 14*b*, 14*c* or 14*d* of successive rows of U-shaped monofilaments 13*b*, 13*c* or 13*d* by about one half the width of the spacing between the U-shaped monofilaments 13*b*, 13*c* or 13*d* in a direction normal to the edges 19*b*, 19*c* or 19*d*. This insures that there is no uninterrupted path between the stems 14*b*, 14*c* or 14*d* in a direction parallel to the edges 19*b*, 19*c* or 19*d*.

Like the articles 10 and 50, the articles 60, 70 and 80 each comprise a backing 12*b*, 12*c* or 12*d* having parallel edges 19*b*, 19*c* or 19*d*. In a surface layer of the backing are bonded a multiplicity of flexible resilient generally U-shaped monofilaments 13*b*, 13*c* or 13*d* of longitudinally oriented polymeric material. Each monofilament 13*b*, 13*c* or 13*d* includes a central bight portion 17*b*, 17*c* or 17*d*, and two projecting stem portions 14*b*, 14*c* or 14*d* each terminating in a head 18*b*, 18*c* or 18*d* defining an outer cam surface 20*b*, 20*c* or 20*d*. Also, like the articles 11 and 50, the bight portions 17*b*, 17*c* or 17*d* of the U-shaped monofilaments 13*b*, 13*c* or 13*d* are disposed generally parallel to each other, and a plurality of groups of the bight portions 17*b*, 17*c* or 17*d* are disposed generally side by side to form a plurality of generally parallel straight rows of U-shaped monofilaments 13*b*, 13*c* or 13*d* and heads 18*b*, 18*c* or 18*d* disposed at generally a right angle with the parallel edges 19*b*, 19*c* or 19*d*. In each of the articles 60, 70 or 80 it will be noted that the U-shaped monofilaments 13*b*, 13*c* or 13*d* in successive rows are not aligned in a direction parallel with the edges 19*b*, 19*c*, or 19*d* which improves the shear strength of fasteners made from two of the articles 60, 70, or 80 should the rows of U-shaped monofilaments 13*b*, 13*c* or 13*d* be aligned during engagement.

Figure 11:
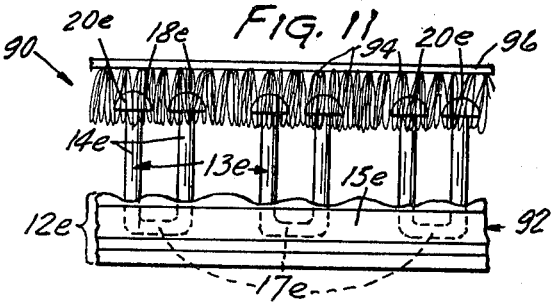
FIG. 11 illustrates an alternate embodiment of the fastener according to the present invention.

FIG. 11 illustrates an alternate embodiment of a fastener 90 according to the present invention in which an article 92 (similar in all respects to the article 10 of FIG. 1 and having similar parts similarly numbered with the addition of the suffix "e") is engaged with projecting fiber loops 94 projecting from the woven backing 96 of an article 98 comprising a length of commercially available material such as that designated "Scotchmate" brand nylon woven loop No. SJ3401 available from Minnesota Mining and Manufacturing Company, St. Paul, Minn. As illustrated the article 92 includes a plurality of U-shaped monofilaments 13*e* having bight portions 17*e* bonded in a non-fibrous polymeric surface layer 15*e* of a backing 12*e* for the article 92. The U-shaped monofilaments 13*e* also include stem portions 14*e* projecting from the layer 15*e*. The stem portions 14*e* support heads 18*e* with outer cam surfaces 20*e* adapted to deflect the resilient fiber loops 94 of the article 98 upon engagement therebetween so that the loops 94 releasably catch on latching surfaces 20*e* of the heads 18*e*. As illustrated, the headed U-shaped monofilaments 13*e* are positioned and spaced as were the U-shaped monofilaments 13 of the article 11. Such positioning and spacing is not required to afford proper engagement between the headed stems 14*e* and loops 94, however. Any position of the U-shaped monofilaments is suitable so long as the number of monofilaments is suitable to provide a desired degree of engagement therebetween. The spacing schemes illustrated in FIGS. 7, 8, 9 and 10 are of no advantage, since shear is not a problem, between the loops 94 of the article 98 and the headed stem portions 14*e* of the article 92.

EXAMPLE

The following is a specific non-limiting example of an article of the type shown in FIGS. 1 through 5 produced by the method described with reference to FIG. 6, and test results relating to that article.

The article was made from 0.38 millimeter (0.015 inch) diameter polypropylene monofilament applied to a 25.4 millimeter (1 inch) wide backing comprising a polypropylene surface layer having a thickness of about 0.76 millimeter (0.030 inch). Fifteen of the monofilaments were applied over the central 19 millimeter (¾ inch) of the strip width to provide a spacing of about 1.3 millimeter (0.05 inch) center to center between the stems along the rows of U-shaped filaments. Each U-shaped filament was formed to have a center to center width between its projecting stems of about 1.3 millimeter (0.05 inch), and the adjacent stems of adjacent U-shaped monofilaments in a direction normal to the rows of U-shaped filaments were spaced at about 1.4 millimeter (0.056 inch). The hemispherical heads of the monofilaments were in the range of about 0.9 to 1.0 millimeter (0.035 to 0.040 inch) in diameter and the stems had a length of about 2.3 to 2.8 millimeters (0.090 to 0.110 inch) between the surface layer and the heads.

Two such articles were firmly adhered to a rigid planar member on a testing device that would simultaneously engage and disengage the heads in repetitive cycles. It was found that 1000 engagement-disengagement cycles reduced the force required to disengage the heads from 12.3 to 7.75 kilograms (27.3 to 17.1 pounds), and the force to engage the heads from 14.1–10.7 kilograms (31 to 23.6 pounds). Also after the cycling force required to separate the engaged articles by sliding them relative to each other in the planes of their backing strips was still about 14 kilograms (31 pounds) when the rows of U-shaped monofilaments were disposed at 90 degrees to each other, and between about 5 kilograms (12 pounds) when the rows of U-shaped monofilaments were disposed parallel to each other. After the testing it was noted that none of the U-shaped monofilaments had pulled free of the backing.

I claim:

1. A method for forming a strip material useful as part of a fastener, said method comprising the steps of:

moving two backing layers from generally opposite directions around parallel arcuate spaced guides and away from the guides in the same direction along parallel paths;

feeding spaced parallel flexible, resilient polymeric monofilaments between the spaced guides from the sides thereof opposite said parallel paths;

alternately pressing U-shaped lengths of the flexible monofilaments into engagement with one of the backing layers and then pressing U-shaped lengths of the monofilaments spaced therefrom into engagement with the other backing layer while bonding the U-shaped lengths of the monofilaments to the backing layers in the positions that they are pressed into engagement therewith so that lengths of the monofilaments between the U-shaped lengths extend generally normally between the backing layers as the layers move along the parallel paths;

severing the monofilaments midway between the backing layers to form two brush-like halves; and heating the newly severed terminal ends of the monofilaments projecting from the backing layers to form heads having arcuate surfaces opposite the backing layers;

said feeding step including the step of varying the positions of said monofilaments transversely of said parallel paths so that successive rows of U-shaped lengths of the monofilaments along the backing layers will not be aligned longitudinally of the backing layers.

2. A method for forming a strip material useful as part of a fastener, said method comprising the steps of:

moving two polymeric backing layers from generally opposite directions around parallel arcuate spaced guides and away from the guides in the same direction along parallel paths;

heating the polymeric backing layers on the spaced guides to soften the backing layers;

feeding spaced parallel flexible, resilient polymeric monofilaments between the spaced guides from the sides thereof opposite said parallel paths;

alternately pressing U-shaped lengths of the flexible monofilaments into engagement with one of the backing layers and then pressing U-shaped lengths of the monofilaments spaced therefrom into engagement with the other backing layer to embed and bond the U-shaped lengths of monofilament in the backing layers in the positions that they are pressed into engagement therewith so that lengths of the monofilaments between the U-shaped lengths extend generally normally between the backing layers as the layers move along the parallel paths;

severing the monofilaments between the backing layers to form two brush-like halves; and heating the newly severed terminal ends of the monofilaments projecting from the backing layers to form heads having arcuate surfaces opposite the backing layers.

3. A method for forming a strip material useful as part of a fastener, said method comprising the steps of:

moving two polymeric backing layers from generally opposite directions around parallel arcuate spaced guides and away from the guides in the same direction along parallel paths;

heating the polymeric backing layers on the spaced guides to soften the backing layers;

feeding spaced parallel flexible, resilient monofilaments between the spaced guides from the sides thereof opposite said parallel paths, which monofilaments are of a polymeric material compatible with the material of the backing layer and have a similar softening range;

alternately pressing U-shaped lengths of the flexible monofilaments into engagement with one of the backing layers and then pressing U-shaped lengths of the monofilaments spaced therefrom into engagement with the other backing layer to embed the U-shaped lengths of monofilament in the heated backing layers, soften the embedded portions of the monofilaments, and cause the embedded U-shaped lengths of monofilament to fuse to the backing layers so completely that the materials of the monofilaments are hard to separately identify from the materials of the backing layers, and to cause the lengths of the monofilaments between the U-shaped lengths to extend generally normally between the backing layers as the layers move along the parallel paths;

severing the monofilaments between the backing layers to form two brush-like halves; and heating the newly severed terminal ends of the monofilaments projecting from the backing layers to form heads having arcuate surfaces opposite the backing layer.

4. A method for forming a strip material according to claim 3 wherein said method further includes the step of selecting the amount of heat applied by said heating step and the spacing between the parallel paths of the backing layers to thereby provide a desired size of the heads and length for the monofilaments supporting the heads above the backing layers, and selecting the spacing between the monofilaments being fed between the spaced guides, the timing between said moving step and said pressing step and the width of said U-shaped lengths of the monofilaments to position said monofilaments in a pattern having sufficient spaces between the heads to afford resilient deflection of the lengths of the monofilament supporting the heads above the backing layers and movement of the heads on one portion of the strip material past the heads on another portion of the strip material while providing firm, releasable engagement between the heads when the backing layers of said portions are maintained in opposed parallel relationship.

5. A method for forming a strip material useful as part of a fastener, said method comprising the steps of:

moving two backing layers from generally opposite directions around parallel arcuate spaced guides and away from the guides in the same direction along parallel paths;

feeding spaced parallel flexible, resilient polymeric monofilaments the spaced guides from the sides thereof opposite said parallel paths;

heating the polymeric backing layers to soften the backing layers;

alternately pressing U-shaped lengths of the flexible monofilaments into engagement with one of the backing layers and then pressing U-shaped lengths of the monofilaments spaced therefrom into engagement with the other backing layer to embed and bond the U-shaped lengths of the monofilaments in the backing layers in the positions that they are pressed into engagement therewith so that lengths of the monofilaments between the U-shaped lengths extend generally normally between the backing layers as the layers move along the parallel paths;

severing the monofilaments between the backing layers to form two brush-like halves;

heating the newly severed terminal ends of the monofilaments projecting from the backing layers to form heads having arcuate surfaces opposite the backing layers; and selecting the amount of heat applied by said heating step and spacing between the parallel paths of the backing layers to thereby provide a desired size of the heads and length for the monofilaments supporting the heads above the backing layers, and selecting the spacing between the monofilaments being fed between the spaced guides, the timing between said moving step and said pressing step and the width of said U-shaped lengths of the monofilaments to position said monofilaments in a pattern having sufficient spaces between the heads to afford resilient deflection of the lengths of the monofilament supporting the heads above the backing layers and movement of the heads on one portion of the strip material past the heads on another portion of the strip material while providing firm, releasable engagement between the heads when the backing layers of said portions are maintained in opposed parallel relationship.

* * * * *

UNITED STATES PATENT AND TRADEMARK OFFICE

CERTIFICATE OF CORRECTION

PATENT NO. : 4,290,832

DATED : September 22, 1981

INVENTOR(S) : Melvin O. Kalleberg

It is certified that error appears in the above-identified patent and that said Letters Patent is hereby corrected as shown below:

Col. 3, line 46, "be" should read --by--.

Col. 6, line 34, "3-650-vt" should read --3-650-VT--.

Col. 12, line 2, after "monofilaments" insert --between--.

Col. 12, line 4, "polymeric" should read --polymer--.

Signed and Sealed this

*Sixteenth* Day of *July 1985*

[SEAL]

*Attest:*

DONALD J. QUIGG

*Attesting Officer*

*Acting Commissioner of Patents and Trademarks*